United States Patent [19]

Lindstedt et al.

[11] 4,455,116

[45] Jun. 19, 1984

[54] DRILL PIPE HANDLING AND STORAGE APPARATUS

[75] Inventors: Ernst L. Lindstedt, Garland; Robert W. Hisey, Richardson, both of Tex.

[73] Assignee: Cooper Industries, Inc., Houston, Tex.

[21] Appl. No.: 320,159

[22] Filed: Nov. 10, 1981

[51] Int. Cl.[3] ..... E21B 19/14

[52] U.S. Cl. ..... 414/22; 414/745; 175/52; 211/60 S; 294/106

[58] Field of Search ..... 414/22, 564, 736, 744 A, 414/745, 910; 175/52, 85; 166/77.5, 85; 294/106; 211/60 S

[56] References Cited

U.S. PATENT DOCUMENTS

| | | | |
|---|---|---|---|
| Re. 30,071 | 8/1979 | Hilding | 175/52 |
| 3,025,918 | 3/1962 | Leven | 175/52 |
| 3,157,286 | 3/1963 | Gyongyosi | 175/52 |
| 3,212,593 | 10/1965 | Reischl | 414/22 |
| 3,493,061 | 5/1967 | Gyongyosi | 175/52 |
| 3,741,322 | 10/1973 | Wolters | 175/52 |
| 3,828,943 | 8/1974 | Simon | 414/736 X |
| 3,913,753 | 10/1975 | Swartz et al. | 414/22 |
| 3,913,754 | 10/1975 | Swartz | 414/22 |
| 3,966,053 | 6/1976 | Loftis | 174/52 |
| 3,985,189 | 10/1976 | Jahnke | 175/52 |
| 4,049,065 | 9/1977 | Walter | 175/52 |
| 4,050,590 | 9/1977 | Benjamin | 414/22 |

*Primary Examiner*—Robert J. Spar
*Assistant Examiner*—Ken Muney
*Attorney, Agent, or Firm*—Eddie E. Scott; Michael D. McCully

[57] ABSTRACT

A drill pipe carousel is pivotal within a drilling mast between retracted and operating positions. The carousel contains a plurality of drill pipe receptacles for holding sections of drill pipe. Each of these drill pipe receptacles includes an upper and lower set of clamps that selectively clamp around a section of drill pipe within the receptacle to retain it in place, and open to release the pipe section. In the carousel operating position, a section of drill pipe is in alignment with the drill hole and a rotary head mounted on the drilling mast for linear movement along the mast. The rotary head attaches to this drill pipe section and rotates it to drill into the drill hole as the rotary head moves along the mast. The carousel pivots into the mast, out of the way of the rotary head, and rotates to align a subsequent section of drill pipe with the rotary head and drill hole when the rotary head is again raised to attach to the subsequent drill pipe section and the carousel is again pivoted outwardly from the drilling mast to its operating position.

12 Claims, 9 Drawing Figures fig.3
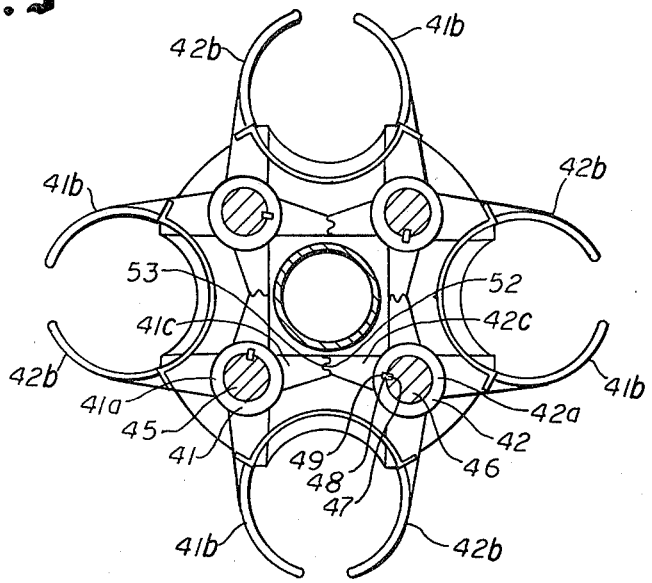
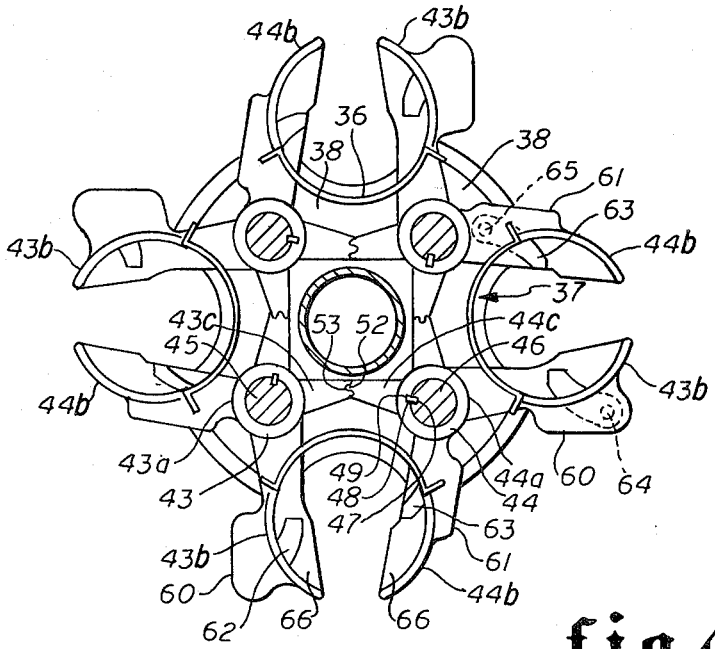
fig.4

DRILL PIPE HANDLING AND STORAGE APPARATUS

BACKGROUND OF THE INVENTION

1. Field of the invention

The present invention relates in general to drilling apparatus for boring a hole into the earth, and more particularly to an apparatus for handling and storing drill pipe sections used in drilling operations.

2. Description of the prior art

Various drill pipe carousel/magazine devices are in general use today with a drilling rig for handling and storing sections of drill pipe. Drilling rigs of this type typically have an upright mast with a drill table or floor at the lower end thereof and a rotary drive mechanism or rotary head mounted on the mast for linear movement therealong as the drill string is drilled into the earth in a generally vertical direction. In conventional blasthole drillings, usually only shallow holes are necessary; therefore, one thirty to fifty-five foot section of drill pipe remains attached to the rotary head with a drill bit attached to the lower end thereof. As the drill pipe is rotated, a downward force is applied by the rotary head, causing the drill bit to bore the hole in the earth. When the drill bit has reached the required depth, it is retracted up into the mast, and the portable drilling rig is relocated to the next location where a blasthole is to be drilled.

When it becomes necessary to drill holes deeper than the single pass capability of the drill, (i.e., the length of a single drill pipe section), a plurality of drill pipe sections are attached end to end, forming a drill string for boring this deeper hole. In this instance, the initial drilling section must be released from the rotary head and subsequent drill pipe sections connected therebetween. Conventionally, these subsequent drill pipe sections are carried by a "Lazy Susan" type drill pipe carousel or magazine which is housed within the mast. The carousel rotates about an axis parallel to that of the drill hole in the earth and positions these drill pipe sections in line with center line of the drill hole. A typical drill pipe carousel has a plurality of sockets at the lower end thereof, each for retaining the lower end of a drill pipe section, and a generally elongated or oval slot in a plate at the upper end thereof for receiving a reduced top section of the drill pipe. The drill pipe has opposite flat surfaces for engaging the slot. Once engaged, the drill pipe is then rotated slightly to engage a locking mechanism for retaining the top section of the drill pipe therein.

The drill pipe carousel is pivotally connected to the mast so that it, as a unit, may pivot outwardly from a stored position to an operating position where one of the drill pipe sections is in line with the rotary head and drill hole. In this operating position, the rotary head is lowered to attach the rotary driving spindle to the male threads at the top of the drill pipe. With this connection made, the rotary head is raised, removing the lower section of the drill pipe from its retaining receptacle, or socket. Next, the carousel is pivoted back into the mast, out of the way, so that the rotary head may be lowered and the lower end of the drill pipe section connected to the upper end of the drill pipe section already in the hole. After drilling a depth equal to the length of the drill pipe section, the top of the section of drill pipe remaining in the hole is clamped to prevent it from rotating, the rotary head spindle is unscrewed from the drill string and the rotary head raised to the top of the mast so that the carousel may again be pivoted into place, aligning a subsequent section of drill pipe with the rotary head and drill hole, after which the process repeats itself as described hereinabove.

When removing the drill string from the drill hole, the above procedure is reversed. Specifically, the rotary head with the drill string attached is raised so that a length of drill pipe section is removed from the drill hole. In this position, the top of the section of drill pipe remaining in the hole is clamped to prevent it from falling back into the hole and also to prevent it from rotating as the top, just withdrawn section of drill pipe is unscrewed therefrom. After this top section of drill pipe is unscrewed from the drill string, the rotary head is further raised and the drill pipe carousel pivoted into place so that the drill pipe socket at the lower end thereof is in alignment with the drill pipe section and the drill hole. The rotary head is then lowered so that the drill pipe section is inserted into the socket, and the top of the drill pipe section "keyed" into the elongated slot in the upper retaining plate thereof. Slight further counterclockwise rotation of the drill pipe will lock it into place within the carousel. Further counterclockwise rotation will unscrew the rotary head spindle from the drill pipe section, which permits the carousel to be pivoted back out of the way so that the rotary head may again be lowered and the spindle attached to the section of drill pipe within the hole, and the process repeated as set out hereinabove.

When drilling directionally, i.e., nonvertical holes, an additional device is required to retain the drill pipe section in alignment with the drill hole as the pipe section is being attached to or removed from the drill string in the hole, as this "free" end of the drill pipe section connected to the rotary head will fall under its own weight when disconnected from the drill string or when the carousel is pivoted back into the mast out of the way of the rotary head. When directional drilling, the additional step of positioning this drill pipe retaining device at the bottom of the mast must be included to retain the drill pipe section in alignment with the drill hole, and must be removed once this connection is made so that it will not interfere with the rotary head as drilling proceeds.

These conventional devices are inefficient in that additional steps, made unnecessary by the present invention, are required to perform the drilling operation. Specifically, after the connection is made between the drill pipe and the rotary head, the rotary head must be raised to withdraw the drill pipe from its retaining socket in the lower portion of the carousel, after which the carousel must be pivoted back out of the way in order not to interfere with the downward motion of the rotary head. Likewise, when removing the drill pipe from the drill string, the rotary head must be raised sufficiently to permit the bottom of the drill pipe section to clear the drill pipe socket in the carousel, but not raised so much that the "flat" sections at the top of the drill pipe are above the carousel top retaining plate. The drill pipe section must be incrementally rotated so that the flat sections thereof are in alignment with the elongate slot in the drill pipe carousel upper retaining plate. After this alignment is made, the carousel may be pivoted into place and the rotary head lowered, lowering the bottom section of the drill pipe into the carousel pipe retaining socket. This is a very tedious and time consuming operation.

SUMMARY OF THE INVENTION

The present invention is embodied in a portable drill pipe carousel which is pivotally mounted on a drilling mast, and is movable between a retracted position, usually within the mast, to an operating position in which one of the drill pipe sections is in alignment with the rotary head and drill hole. In this position, the carousel is rotatable so that each of the pipe sections retained therein, sequentially, is in alignment with the drill hole. The drill pipe sections are retained within the carousel by sets of jaws or clamps that clamp around the pipe to retain it within a pipe receptacle defined by the carousel frame housing, and open to release the drill pipe section therefrom. In addition, the rotary head includes an extended rotary spindle that attaches to the upper end of the drill pipe section so that the rotary head may be rotating the drill string and drill bit to bore the hole at the same time the carousel is being pivoted out of the way into its retracted position within the mast structure.

BRIEF DESCRIPTION OF THE DRAWINGS

For a detailed description of the preferred embodiment of the invention, reference is made to the accompanying drawings, in which:

FIG. 3 is a sectional view taken through the upper pipe clamps of the apparatus of the present invention transverse to the axis of rotation;

FIG. 4 is a sectional view taken through the lower pipe clamps of the apparatus of the present invention transverse to the axis of rotation;

DESCRIPTION OF THE PREFERRED EMBODIMENT

Figure 1:
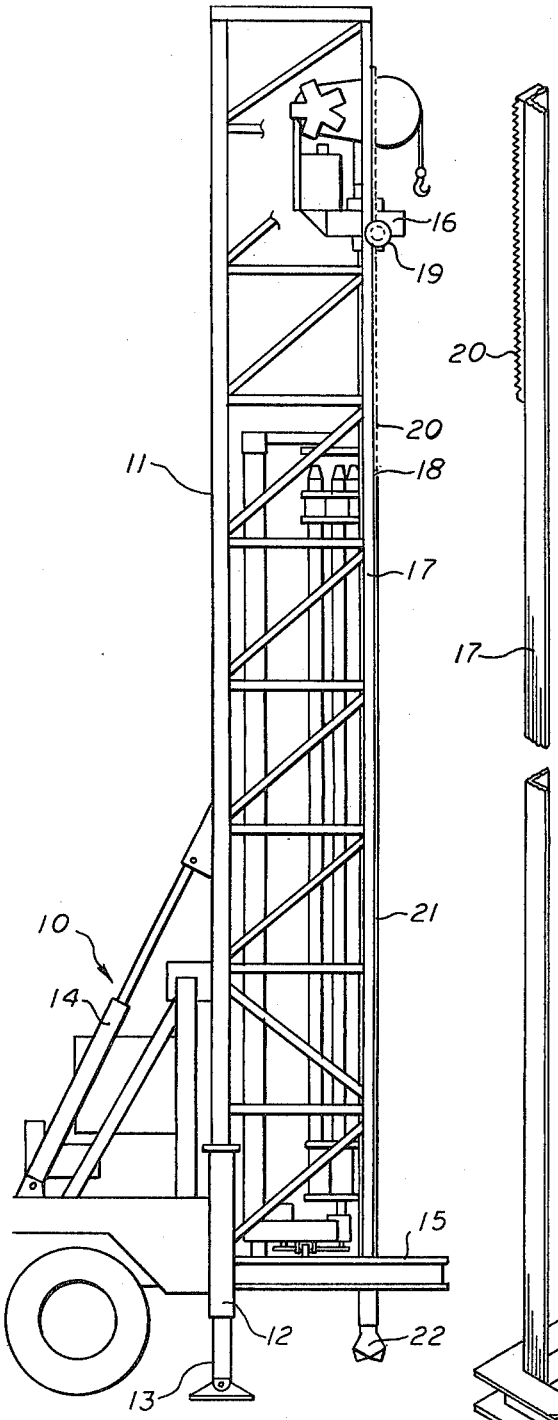
FIG. 1 is a side elevation of a mobile mast structure utilizing the present invention.

Turning now to the drawings, and more specifically to FIG. 1, a vehicle 10 is shown having an elongate mast 11 pivotally mounted thereon. Usually the mast is positioned generally horizontally on the vehicle and is raised to the vertical position, as shown in FIG. 1, when it is desired to bore a hole into the earth. The vehicle includes a plurality of jacks 12 having telescoping feet 13 for engaging the ground to level and stabilize the vehicle and mast unit thereupon. Once the vehicle is stabilized, hydraulic cylinders 14 pivot the elongate mast 11 upwardly to a generally vertical position as shown in FIG. 1, or any suitable drilling angle required.

The drilling mast structure includes a drill table 15 to support the workers while performing various duties necessary to the drilling operation. The mast 11 also includes a rotary driving member, commonly called a rotary head, 16 mounted thereto, usually along the back surface 17 of the mast. In the instant invention, the rotary head 16 includes an extended drill pipe driving shaft, commonly called a rotary spindle 18. As will be explained hereinbelow, this extended rotary spindle 18 functions to permit the rotary head 16 to be lowered simultaneously with pivotal movement of the drill pipe carousel relative to the mast. The rotary head 16 is adapted to travel along the mast back surface 17 by means of rotary head drive gears 19 engaging mast linear teeth 20.

A section of drill pipe 21 is threadedly connected to the rotary spindle 18, and has a drill bit 22 threadedly connected thereto at the lower end thereof in a conventional manner. As the rotary head 16 turns the drill bit 22 through the drill pipe section 21, the drill bit bores into the earth in the conventional manner. Drilling force is supplied axially along the drill pipe section 21 and drill bit 22 through the rotary head drive gears 19 meshing with the mast back surface linear teeth 20 as the rotary head 16 travels linearly therealong.

When a hole has been drilled in the earth to the depth of the length of the section of drill pipe 21, the rotary head spindle 18 is unscrewed from the upper section of the drill pipe, the rotary head 16 raised to its initial top starting position and a subsequent section of drill pipe installed between the rotary head and section of drill pipe positioned within the drill hole. Such function is performed by the handling and storing apparatus of the present invention, generally illustrated in FIG. 2 by the numeral 24. This drill pipe handling and storing apparatus, commonly called a drill pipe carousel, 24 is adapted to rotate about a first axis 25 to supply the various drill pipe sections 21 to the rotary head 16. The drill pipe carousel 24 is rotatably connected to upper and lower support arms 26, 27, respectively. These support arms are connected to a mast cylindrical member 28, which is concentric with, and adapted to pivot about, a shaft 29 defining a second axis of rotation 30, in a manner to permit the drill pipe carousel 24 to pivot from its normally retracted position within the framework of the mast 11 outwardly to an operating position wherein one of the drill pipe sections 21 is in line with the rotary head spindle 18 and the drill hole, as will be explained in greater detail hereinbelow.

The drill pipe carousel 24 of the present invention comprises a central frame 31 adapted to rotate about the first axis 25. The carousel frame 31 includes upper and lower mounting shafts 32, 33, respectively, which are supported by, and adapted to rotate within, respective bearings 34, 35 mounted within respective carousel support arms 26, 27. The lower bearing 35 also includes a thrust bearing therein to support the weight of the carousel 24 and drill pipe. A support roller 39 is mounted within a frame 40 attached to the lower carousel support arm 27, and is adapted to roll on the drill table 15 to support most of the weight of the carousel and drill pipe.

The carousel central frame 31 includes a plurality of concave surfaces 36, each extending essentially the entire length of the frame, and defining respective drill pipe receptacles 37, each for receiving a section of drill pipe 21. These concave surfaces 36 are adapted to accommodate standard diameter drill pipe, but also may have inserts (not shown) installed therein to accommodate smaller diameter pipe.

Figure 2:
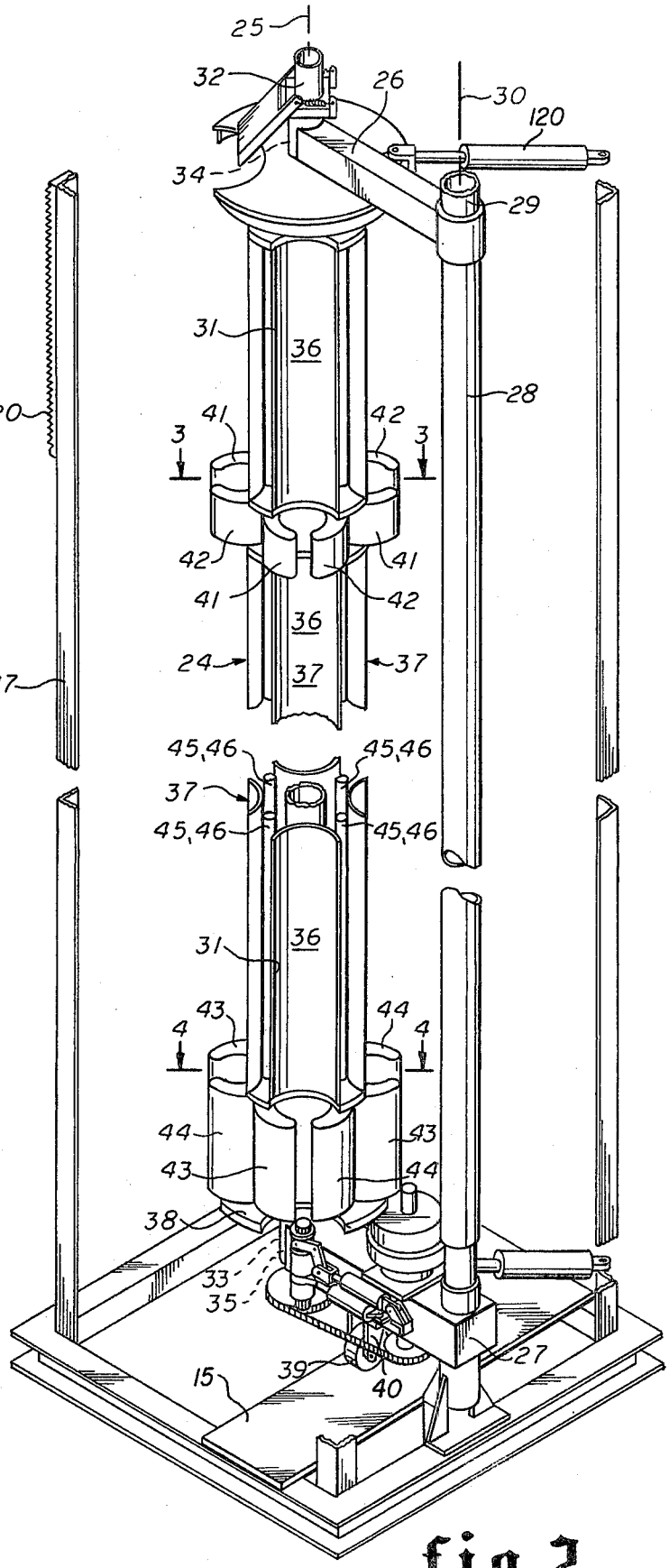
FIG. 2 is a fragmentary perspective view of the carousel of the present invention.

As shown in FIGS. 2 and 3, corresponding to each of the drill pipe receptacles 37, there is provided a set of left and right upper pipe clamps 41, 42, respectively, for retaining a section of drill pipe within the receptacle. Additionally, as shown in FIG. 4, the carousel frame 31 further includes a set of left and right lower pipe clamps 43, 44, respectively, for supporting the lower end of the drill pipe section. Each of the pipe clamps 41–44 comprises a generally cylindrical body section 41*a*–44*a*, a curved pipe retaining section 41*b*–44*b*, and gear tooth section 41*c*–44*c*, as will be explained in greater detail hereinbelow. As best shown in FIGS. 3 and 4, the left upper and lower pipe clamps 41, 43 are retained within the carousel frame 31 by a left clamp rod 45. Similarly, the right upper and lower pipe clamps 42, 44 are retained within the carousel frame 31 by a right clamp rod 46. The respective clamp rods 45, 46 are positioned within the left and right upper and lower pipe clamps 41, 43 and 42, 44, respectively, to open and close the clamps as described hereinbelow. The right clamp rod 46 contains key slots 47 at the upper and lower ends thereof adjacent respective right upper and lower pipe clamps 42, 44. Each of these respective key slots carries within it a key 48 which extends into mating key slots 49 of each right clamp 42, 44.

The right upper pipe clamp 42 gear tooth section 42*c* extends toward a mating gear tooth section 41*c* of the left upper pipe clamp 41. As best shown in FIG. 3, each of these gear tooth sections 42*c*, 41*c* contains respective mating teeth 52, 53 that mesh together in a manner similar to those of circular gear teeth to synchronize the left and right upper clamps 41, 42 to open to release a drill pipe section held therein. As will be explained in greater detail hereinbelow, since the left upper and lower pipe clamps 41, 43 are not keyed to the clamp rod 45, they are free to rotate thereon in response to the action of respective right upper and lower pipe clamps 42, 44.

As shown in FIGS. 3 and 4, when the right clamp rod 46 is rotated counterclockwise, the right upper and lower pipe clamps, being keyed thereto, will also rotate in a counterclockwise direction. This action is transmitted through the right and left teeth 52, 53 to cause the left upper and lower pipe clamps to rotate in a clockwise direction simultaneously with the right upper and lower pipe clamps to release a drill pipe held within the drill pipe receptacle 37. Likewise, clockwise rotation of the right clamp rod 46 causes the right upper and lower pipe clamps 42, 44 to rotate clockwise, causing the left upper and lower pipe clamps to rotate in a counterclockwise direction simultaneously therewith to close each of the pipe clamps in a drill pipe section retaining position.

As best shown in FIG. 4, the respective left and right lower clamp pipe retaining sections 43*b*, 44*b* further include left and right catch housings 60, 61 formed therewith. Within each of these housings 60, 61 is pivotally mounted respective left and right drill pipe catch members 62, 63 mounted on respective pins 64, 65 to pivot thereabout. Each catch member 62, 63 is urged in a clockwise direction about the respective pins 64, 65 by a spring biasing member (not shown) in a manner to engage respective opposite slots formed in the drill pipe section 21 to catch the drill pipe and prevent it from rotating in the counterclockwise direction.

Each lower pipe clamp 43, 44 also includes a lower semi-annular lip 66 integrally formed therewith for engaging the bottom edge of the drill pipe section and supporting the drill pipe section within the drill pipe receptacle 37.

Figure 5:
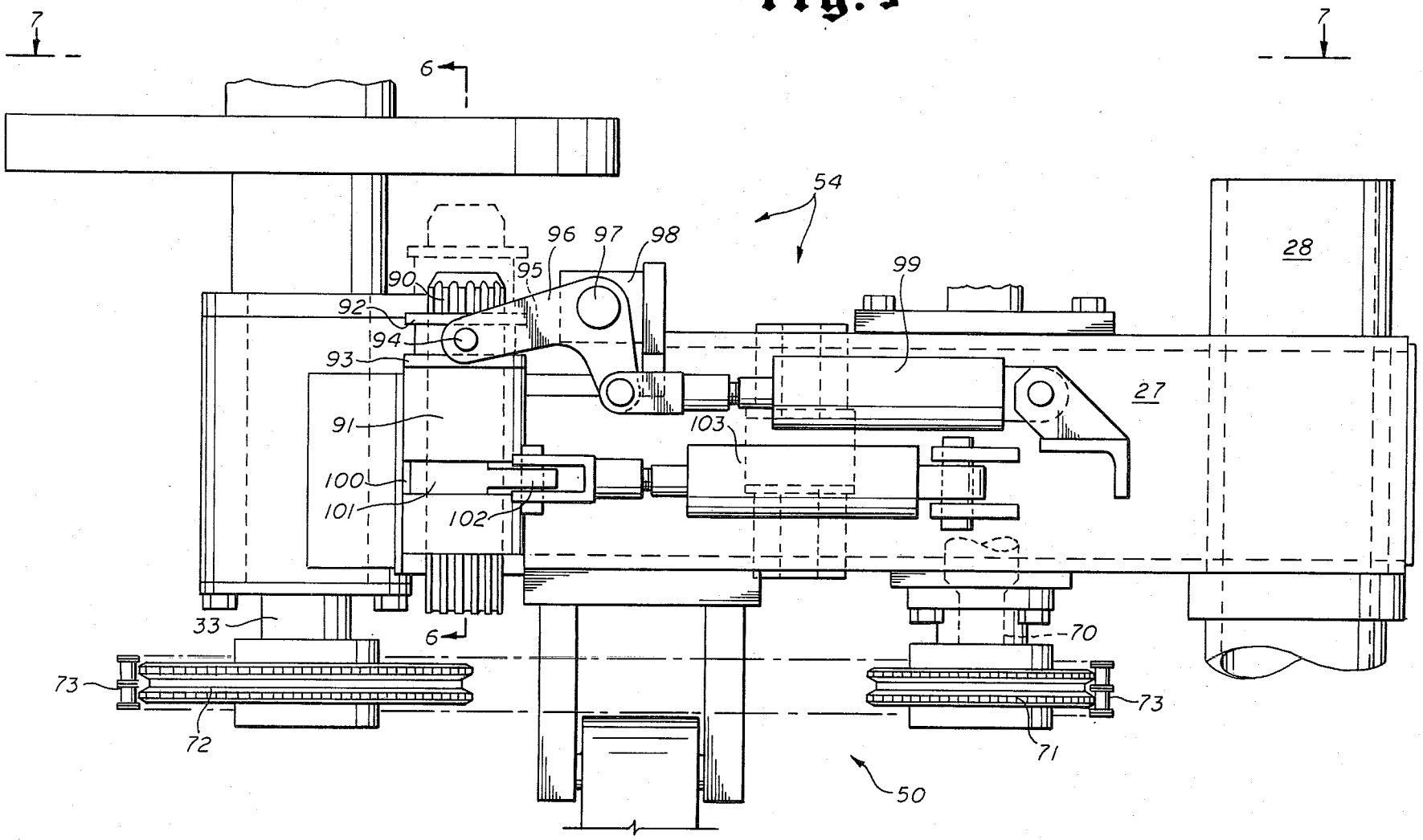
FIG. 5 is a front elevation of the lower carousel support arm showing the pipe clamp actuating mechanism.

The carousel frame 31 is rotated about its first axis 25 by means of a chain and sprocket mechanism 50, as best shown in FIG. 5. This chain and sprocket mechanism is attached to the lower carousel support arm 27, and comprises a motor and gear mechanism (not shown) a drive axle 70, a drive sprocket 71 mounted on the drive axle, a driven sprocket 72 mounted on the lower carousel mounting shaft 33, and a chain 73 connecting the two sprockets in a conventional manner.

Figure 8:
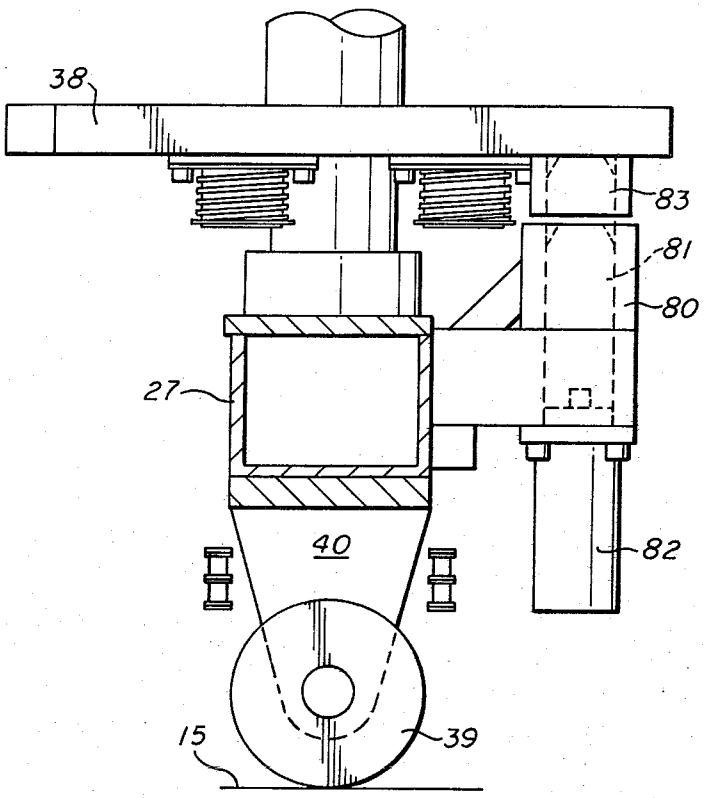
FIG. 8 is a vertical sectional view taken through the carousel locking pin mechanism as shown in FIG. 7.

The drill pipe carousel 24 of the present invention also includes means for indexing and locking the carousel relative to the lower support arm 27. As best shown in FIG. 8, this indexing and locking means comprises a pin housing 80 mounted with the lower support arm 27. This pin housing 80 carries within it an indexing and locking pin 81 which is actuated by a hydraulic cylinder 82 in the preferred embodiment. To lock the carousel frame 31 with respect to the lower support arm 27, the hydraulic cylinder 82 is actuated to raise the indexing and locking pin 81 upwardly into a pin receptacle 83 mounted on the lower plate 38 of the carousel frame 31. Even though, for purposes of explanation, only one indexing and locking means is described, it will be understood that one pin receptacle 83 is provided for each drill pipe receptacle 37, i.e., the number of drill pipe sections the carousel 24 is adapted to carry. The indexing and locking pin 81 selectively engages one of such pin receptacles 83 to retain the carousel 24 in the selected position.

Figure 6B:
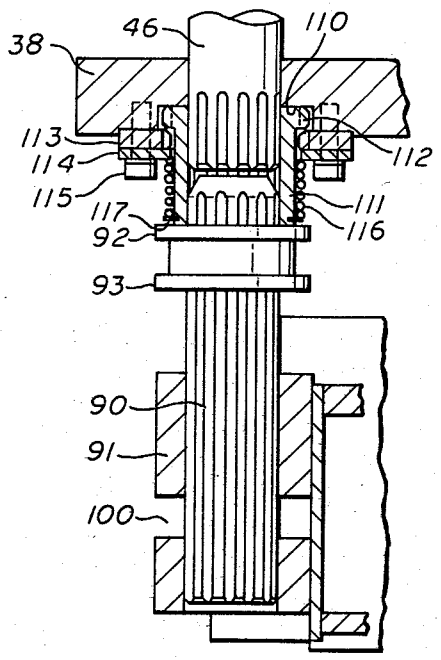
FIG. 6B is a view similar to FIG. 6A showing the splined pin in its up, unlocked position.
Figure 6A:
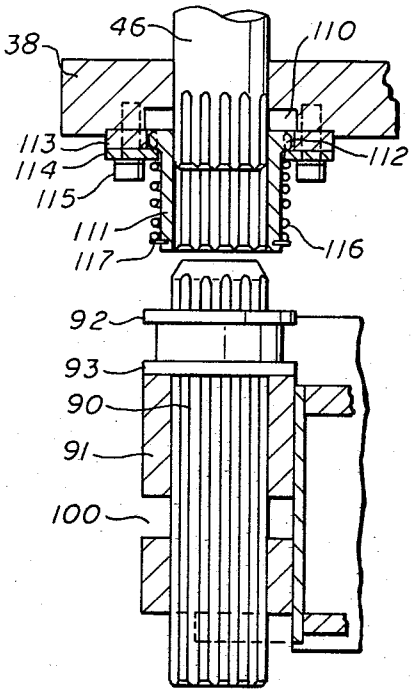
FIG. 6A is a vertical sectional view taken through the splined pin shown in FIG. 5 showing the splined pin in its down, locked position.
Figure 7:
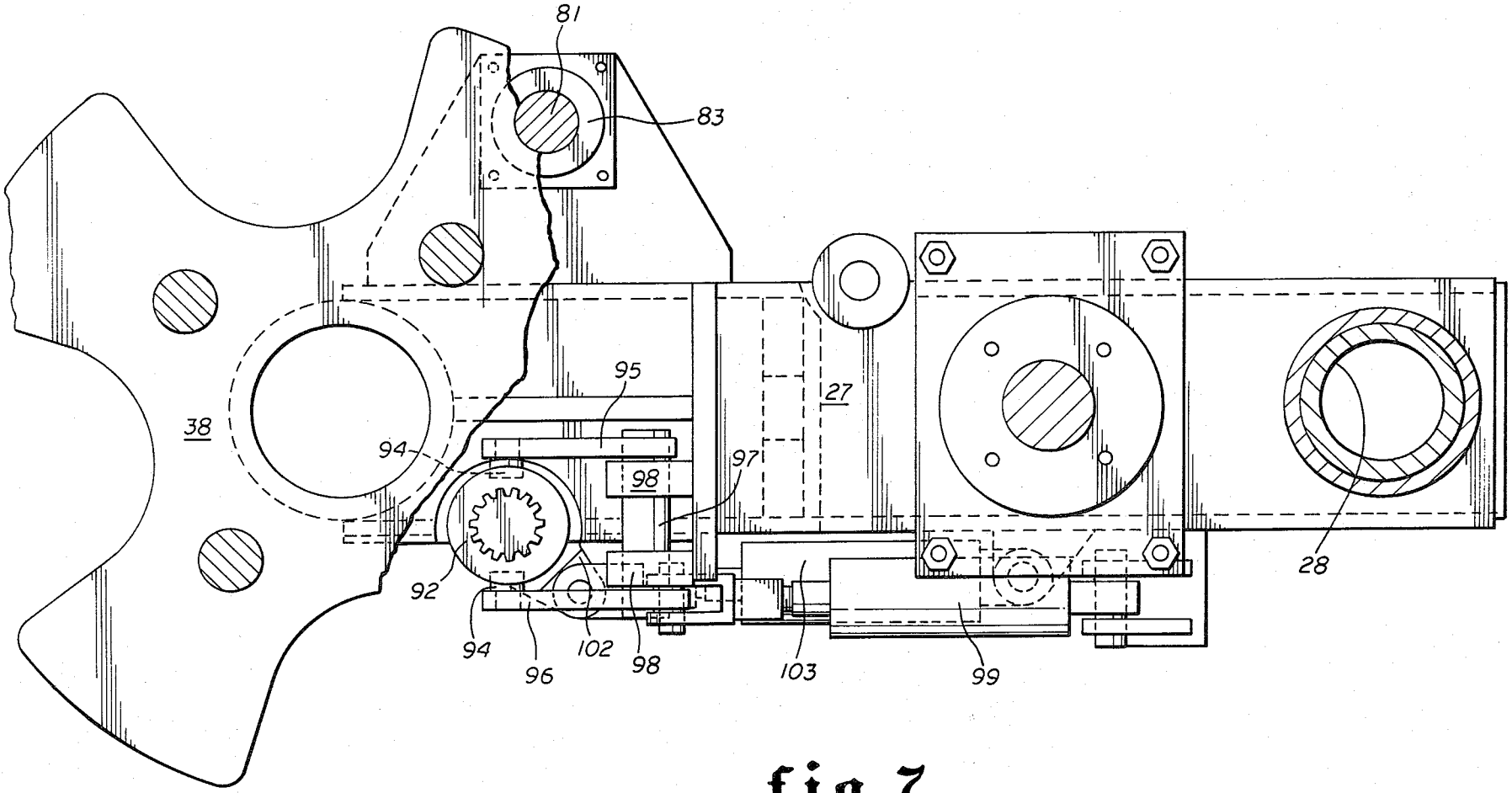
FIG. 7 is a horizontal sectional view taken through the carousel bottom plate, showing the positions of the carousel indexing and locking pin mechanism and pipe clamp shifting splined pin.

The drill pipe carousel 24 of the present invention includes a pipe clamp actuating mechanism 54, illustrated in FIGS. 5, 6A and 6B. This clamp actuating mechanism 54 includes a keyed or splined pin 90 adapted to slide axially and rotate within a housing 91. The splined pin 90 includes upper and lower annular flange rings 92, 93 mounted therewith. A pair flange riders 94 is positioned between the upper and lower flange rings 92, 93. Each of these flange riders 94 is attached to a respective pivot arm 95, 96. The pivot arms 95 and 96 are connected together by a pivot pin 97 press-fitted thereinto in a manner to maintain the flange riders 94 in axial alignment as the pivot arms pivot with the pin 97. As shown in the drawings, the outermost pivot arm 96 is formed in an "L" shape to enable the pivot assembly (i.e., the arms, pin and riders) to be connected to and actuated by a hydraulic cylinder 99 mounted to the lower support arm 27.

The housing 91 carrying the splined pin 90 includes a semi-annular open slot 100 for receiving a keyed collar 101 keyed to the pin 90 to impart rotation thereto. In the preferred embodiment these keyed pins and collars take the form of splined pins and collars and are keyed to each other through the series of keys, commonly called splines. The splined collar 101 includes an ear portion 102 projecting from the semi-annular open slot 100. This ear portion 102 is connected to a second hydraulic cylinder 103 mounted to the lower support 27 in a conventional manner to be actuated thereby to rotate the splined pin 90 within the housing 91.

FIGS. 6A and 6B show the engagement of the splined pin 90 and the right clamp rod 46. The carousel frame lower plate 38 includes an annular cavity 110 concentric with the clamp rod 46. A splined sleeve 111 is adapted to be received within this annular cavity 110 and is carried by the clamp rod 46. The splined sleeve 111 includes an externally splined annular shoulder 112 adapted to engage an internally splined locking plate 113 mounted on the under side of the carousel frame lower plate 38 by a suitable washer 114 and bolts 115. A resilient coil spring 116 is positioned around the splined sleeve 111 and is retained in place by a retaining ring 117 to urge the splined sleeve downwardly into its normally locked position.

In operation, the vehicle 10 is driven to the sight wherein a hole is to be drilled into the earth. With the vehicle 10 in position, the telescoping feet 13 are extended from the jacks 12 in order to level and stabilize the unit for drilling operations. Hydraulic cylinders 14 are actuated to raise the mast 11 to a generally upright position for drilling a hole. During these operations, the drill pipe carousel of the present invention normally contains a plurality (four in the illustrations) of drill pipe sections 21. The carousel is normally retracted into a stored position within the mast 11, and is pivoted outwardly when it is desired to remove and utilize a drill pipe section therefrom, as will be described hereinbelow.

With the mast 11 in an upright position, the rotary head 16 is operated to rotate the drill pipe and drill bit 22 to bore a hole into the earth. When the hole is bored to a depth equal to the length of drill pipe section 21, the rotary spindle 18 is disconnected from the section of drill pipe presently in the hole in the earth, and the rotary head 16 raised to its initial starting position at the top of the mast 11. As the rotary head 16 nears the top of the mast, a hydraulic cylinder 120 is actuated to pivot the drill pipe carousel outwardly from its stored position to an operating position wherein a section of drill pipe carried by the carousel is in line with the rotary head spindle and center line of the drill hole. The extended rotary spindle 18 permits the carousel to be moved into position as the rotary head 16 is being raised, and also permits the rotary head to begin rotating the drill bit and drilling downwardly simultaneously with the movement of the drill pipe carousel back into its stored position.

With the drill pipe carousel in its outermost operational position, one of the plurality of drill pipe sections is in line with the rotary spindle 18 and center line of the drill hole in the earth. The rotary head 16 is lowered and the rotary spindle 18 is connected to the top end of such drill pipe section. When a positive connection is made between the rotary spindle and the drill pipe section, the hydraulic cylinder 99 is actuated to raise the splined pin 90 up into engagement with the splined sleeve 111 (see FIG. 5). As this engagement is made, the splined pin upper annular flange ring 92 (see FIG. 6B) engages the bottom surface of the splined sleeve 111 to shift the sleeve up into the carousel frame lower plate annular cavity 110, thus disengaging the splined sleeve externally splined annular shoulder 112 from the internally splined locking plate 113. In this position, the splined sleeve and clamp rod 46 are free to rotate with the splined pin 90. Thereafter, the hydraulic cylinder 103 is actuated by a sequence valve (not shown) to pull the splined collar ear portion 102 from left to right as shown in the drawings. This action rotates the splined pin in the counterclockwise direction as viewed from the top, which causes the right upper and lower pipe clamps 42, 44 to open. As noted hereinabove, when the right pipe clamps 42, 44 are rotated in a counterclockwise direction, teeth 52 thereon mesh with teeth 53 on the left upper and lower pipe clamps 41, 43, causing the left clamps to open simultaneously with the right, thus releasing the drill pipe section from the pipe receptacle 37.

With the pipe clamps 41–44 open, the rotary head 16 is lowered to bring the bottom end of the drill pipe section into engagement with the top end of that drill pipe section within the drill hole. With the drill pipe carousel in its outermost position and the pipe clamps in their open position, the carousel may serve as a guide to guide the two sections of drill pipe into alignment. Once this joint between the pipe section in the drill hole and the next section is made, drilling continues until this joint is below the carousel but above the drill table so that the drill string can be grasped by a set of pipe wrenches on the drill table 15. Simultaneously with the lowering of the rotary head 16, the hydraulic cylinder 120 may be actuated to retract the drill pipe carousel back into its stored position within the mast 11, so that the carousel will not interfere with the downward movement of the rotary head.

As the carousel is being retracted into its stored position, the hydraulic cylinder 103 may be actuated to rotate the clamp rod 46 in the clockwise direction to close the pipe clamps 41–44. Subsequently, hydraulic cylinder 99 is actuated to lower the splined pin 90, disengaging it from the splined sleeve 111, and permitting the coil spring 116 to urge the splined sleeve downwardly into locking engagement with the internally splined locking plate 113, thus locking the pipe clamps in their closed position.

As drilling continues, the hydraulic cylinder 82 is actuated to retract the normally extended indexing and locking pin 81 from the locking receptacle 82 into the pin housing 80. With this indexing and locking pin 81 and the splined pin 90 both in their retracted positions, the drill pipe carousel is free to rotate about the first rotating axis 25. At this time, the motor and gear mechanism is actuated to rotate the drive axle 70, the drive sprocket 71 and the driven sprocket 72 through the chain 73 to rotate the carousel (90 degrees in the illustrated embodiment having storage facility for four drill pipe sections) so that the next section of drill pipe may be aligned with the rotary head spindle and center line of the drill hole when the carousel 24 is rotated outwardly to its operational position. In this next aligned position, the hydraulic cylinder 82 is actuated to extend the indexing and locking pin 81 up into the pin receptacle 83, thereby locking the drill pipe carousel with respect to the carousel support arms 26 and 27.

When the drill hole reaches the depth of two sections of drill pipe, the rotary head spindle 18 is disengaged from the top thread of the drill pipe, the rotary head 16 raised to the top of the mast 11, the drill pipe carousel pivoted from its stored position outwardly to the operating position where a drill pipe section carried therein is in line with the rotary head spindle 18 and the center line of the drill hole, and the process for installing a subsequent section of drill pipe is repeated, as outlined hereinabove.

When removing the drill pipe from the drill hole, the sequence of installing drill pipe sections to the drill string is reversed. After the last section of drill pipe has been installed in the drill string and drilling continues, the carousel is pivoted back into its stored position within the mast 11. At this time the pipe clamps 41–44 remain open, as it is unnecessary to close them for this operation. When the proper hole depth is reached, the rotary head 16, including the drill string attached thereto, is raised to its upper position on the mast. As the rotary head 16 reaches a level with the top of the drill pipe carousel, the carousel is pivoted outwardly from its stored position toward the drill string. When the rotary head 16 has reached its top position, using separate pipe wrenches (not shown), the operator clamps onto the top portion of the drill pipe section remaining in the drill hole. Rotating the rotary head 16 in the reverse (i.e., counterclockwise) direction will disengage the top section of drill pipe from that section in the drill hole that is retained by the pipe wrenches. When that connection is broken, the operator closes the pipe clamps 41–44 around that section of drill pipe still attached to the rotary head spindle 18.

As best shown in FIGS. 2 and 4, as the drill pipe section continues to rotate in a counterclockwise direction, the pipe catch members 62, 63 engage respective slots (not shown) in the lower portion of the drill pipe to prevent the drill pipe from further rotating in the counterclockwise direction. Additionally, with the pipe clamps 41–44 in the closed position, the lower annular lip 66 on each of the lower pipe clamps 43, 44 may support the weight of the drill pipe section after the joint between the rotary head spindle 18 and top of the drill pipe section is broken. As the rotary head 16 continues to turn in the reverse direction, the just-mentioned joint is broken and the drill pipe is disengaged from the rotary head. The drill pipe carousel may then be pivoted into its stored position and the rotary head 16 lowered into position to attach the rotary spindle 18 to the top of the drill pipe in the drill string. As the rotary head 16 is being lowered, and the carousel 24 retracted into its stored position, the hydraulic cylinder 82 is actuated to retract the indexing and locking pin 81 from the pin receptacle 83 into its housing 80. With the carousel frame 31 free to rotate about its axis of rotation 25, the motor and gear mechanism is actuated to rotate the carousel to a position where a vacant drill pipe receptacle 37 is available for receiving a section of drill pipe. Additionally, as the rotary head 16 is being lowered, the hydraulic cylinder 99 is actuated to shift the splined pin 90 upwardly into the splined sleeve 111. As described hereinabove, this action causes the splined pin upper annular flange ring 92 to engage the lower surface of the splined sleeve 111 causing it to shift upwardly, thus disengaging the externally splined annular shoulder 112 from the internally splined locking plate 113, thus freeing the splined sleeve 111 and clamp rod 46 to rotate with the splined pin 90. With the rod 46 and splined pin 90 free to rotate, hydraulic cylinder 103 is actuated to pull the splined collar ear portion 102 from left to right as shown in the drawings to rotate the clamp rod 46 in the counterclockwise direction, thus opening the pipe clamps 41–44.

When the rotary head 16 is attached to the top portion of the pipe section extending from the drill hole (i.e., that section of the drill pipe being held by the pipe wrenches, not shown), the process of withdrawing the drill string and removing the top section of drill pipe from the drill string and storing it in the drill pipe carousel of the present invention is repeated, as set forth hereinabove.

From the foregoing, it will be apparent that the present invention comprises an improved "Lazy Susan" type drill pipe carousel having several advantages over previously used devices. As those skilled in the art will appreciate, when the carousel of the present invention is used in directional drilling, it serves to support the lower end of the drill pipe section carried by the rotary head when the joint between that section and the lower section is being made, and also after that joint is broken when the drill string is being removed from the drill hole. This eliminates the need for a separate expensive and awkward drill pipe positioning apparatus attached to the mast. Additionally, since the clamps open to receive the pipe in a direction transverse to the line of travel of the rotary head, the additional step of raising the drill pipe section, moving the carousel into place, lowering the drill pipe section into the base socket, and finally raising the rotary head a second time once the top joint is broken, is eliminated. Likewise, when installing a section of drill pipe in the drill string, the additional step of lowering the rotary head to make the top joint, raising the rotary head to withdraw the pipe section from the carousel lower pipe socket, moving the carousel into its retracted or stored position, and finally lowering the rotary head and pipe section a second time, is also eliminated. Further, the addition of the extended rotary spindle permits simultaneous lowering of the rotary head and retraction of the drill pipe carousel to save time in the pipe changing and drilling operations by eliminating the requirement of completely retracting the drill pipe carousel before the rotary head begins its downward travel to make the joint between the drill pipe sections, and also eliminating the additional time required to raise the rotary head to the top of the mast before moving the carousel out into its operating position to avoid interference therebetween.

Although particular embodiments of the invention have been illustrated in the accompanying drawings and description in the foregoing Detailed Description of the Invention, it will be understood that the invention is not limited to the embodiments disclosed, but is intended to embrace any alternatives, modifications, rearrangements and/or substitutions of elements as fall within the scope of the invention.

What is claimed is:

1. Apparatus for handling and storing a plurality of drill pipe sections for use with a drilling rig having an upright mast and a rotary driving member mounted for movement along said mast, said apparatus comprising:

(a) a carousel adapted to rotate about a first axis, said carousel being pivotally mounted to said mast about a second axis essentially parallel to the first axis, said carousel comprising:

(1) a central frame having an axis of rotation coincident with the first axis of rotation of said carousel, said frame defining a plurality of pipe receptacles, each for receiving a section of drill pipe;

(2) a plurality of sets of pipe clamps corresponding to said plurality of pipe receptacles movably mounted on said frame, each of said pipe clamps being movable between a first position for retaining the section of drill pipe within a corresponding pipe receptacle and a second position releasing the drill pipe;

(3) a plurality of rotatably mounted pipe clamp rods for actuating pipe clamps to shift said pipe clamps between the first and second positions;

(4) clamp shifting apparatus for shifting said pipe clamp rods to thereby shift a respective pipe clamp between the first and second positions; and (5) a clamp rod locking mechanism for selectively locking said pipe clamp rods against rotation to thereby lock respective said pipe clamps in the first or second positions;

(b) a pair of spaced support arms for pivotally mounting said carousel to said mast;
(c) carousel rotating means for selectively rotating said carousel about the first axis; and
(d) carousel indexing and locking means for selectively indexing and locking said carousel relative to said support arms.

2. The apparatus of claim 1, wherein each of said sets of pipe clamps comprises upper and lower left and right pipe clamps positioned adjacent respective upper and lower ends of said carousel and adapted to essentially close together to retain a section drill pipe within a respective said receptacle, and to open to release the drill pipe therefrom.

3. The apparatus of claim 2, wherein each of said lower pipe clamps includes a support lip for supporting the lower edge of the drill pipe.

4. The apparatus of claim 2, wherein each of said lower pipe clamps includes a stop device for limiting rotation of the drill pipe.

5. The apparatus of claim 1, wherein said carousel indexing and locking means comprises:
(a) a plurality of pin receptacles mounted with said carousel central frame;
(b) a pin housing mounted with one of said pair of support arms adjacent said plurality of pin receptacles;
(c) a pin movable within said housing for selectively engaging one of said plurality of pin receptacles for selectively indexing and locking said carousel relative to said support arms; and
(d) an actuating mechanism for selectively shifting said pin between carousel locking and unlocking positions.

6. The apparatus of claim 1, wherein the rotary driving member includes an extended drill pipe driving shaft for permitting the rotary driving member to be lowered simultaneously with pivotal movement of said carousel relative to the mast.

7. The apparatus of claim 1, wherein said pipe clamps comprise left and right arms, said arms comprising toothed sections which intermesh to synchronize movement of said arms.

8. The apparatus of claim 1, wherein each of said pipe clamp rods actuates all of said pipe clamps in a respective pipe receptacle by rotation of said clamp rods.

9. Apparatus for handling and storing a plurality of drill pipe sections for use with a drilling rig having an upright mast and a rotary driving member mounted for movement along said mast, said apparatus comprising:
(a) a carousel adapted to rotate about a first axis, said carousel being pivotally mounted to said mast about a second axis essentially parallel to the first axis, said carousel comprising:
(1) a central frame having an axis of rotation coincident with the first axis of rotation of said carousel, said frame defining a plurality of pipe receptacles, each for receiving a section of drill pipe;
(2) a plurality of sets of pipe clamps corresponding to said plurality of pipe receptacles movably mounted on said frame, each of said pipe clamps being movable between a first position for retaining the section of drill pipe within a corresponding pipe receptacle and a second position releasing the drill pipe;
(3) a plurality of pipe clamp rods for actuating a respective pipe clamp to shift said pipe clamp between the first and second positions;
(4) clamp shifting apparatus for shifting said pipe clamp rods to thereby shift a respective pipe clamp between the first and second positions, wherein said clamp shifting apparatus comprises:
(A) a first keyed sleeve keyed to said pipe clamp rod to rotate therewith;
(B) a keyed pin adapted to selectively engage said first keyed sleeve to rotate with said sleeve and said pipe clamp rod;
(C) a second keyed sleeve keyed to said keyed pin to rotate therewith; and
(D) an actuating mechanism mounted with said second keyed sleeve to cause said sleeve to rotate,
whereby actuation of said actuating mechanism causes said second keyed sleeve to rotate said keyed pin, causing said first keyed sleeve and said pipe clamp rod to rotate to shift said pipe clamp between the first and second positions;
(5) a clamp rod locking mechanism for selectively locking said pipe clamp rods to thereby lock respective said pipe clamps in the first or second positions;
(b) a pair of spaced support arms for pivotally mounting said carousel to said mast;
(c) carousel rotating means for selectively rotating said carousel about the first axis; and
(d) carousel indexing and locking means for selectively indexing and locking said carousel relative to said support arms.

10. The apparatus of claim 9, wherein said clamp rod locking mechanism comprises:
(a) first locking key means mounted with said carousel central frame;
(b) second locking key means formed with said clamp shifting apparatus first keyed sleeve, and adapted to selectively engage said first locking key means to inhibit rotation of said clamp rod relative to said carousel frame; and
(c) resilient means for constantly urging said second locking key means into locking engagement with said first locking key means,
whereby said keyed pin is adapted to selectively engage said first keyed sleeve to urge said sleeve against the action of said resilient means into an unlocked position wherein said first and second locking key means are disengaged, permitting said first keyed sleeve and said pipe clamp rod to rotate to shift said pipe clamp between the first and second positions.

11. Apparatus for handling and storing a plurality of drill pipe sections for use with a drilling rig having an upright mast and a rotary driving member mounted for movement along said mast, said apparatus comprising:
(a) a carousel adapted to rotate about a first axis, said carousel being pivotally mounted to said mast about a second axis essentially parallel to the first axis, said carousel comprising:
(1) a central frame having an axis of rotation coincident with the first axis of rotation of said carousel, said frame defining a plurality of pipe receptacles, each for receiving a section of drill pipe;
(2) a plurality of sets of pipe clamps corresponding to said plurality of pipe receptacles movably mounted on said frame, each of said pipe clamps being movable between a first position for retaining the section of drill pipe within a corresponding pipe receptacle and a second position releasing the drill pipe, each of said sets of pipe clamps comprises upper and lower left and right pipe clamps positioned adjacent respective upper and lower ends of said carousel and adapted to essentially close together to retain a section of drill pipe within a resepective said receptacle, and to open to release the drill pipe therefrom.

(3) a plurality of pipe clamp rods for actuating a respective pipe clamp to shift said pipe clamp between the first and second positions;

(4) clamp shifting apparatus for shifting said pipe clamp rods to thereby shift a respective pipe clamp between the first and second positions, wherein said clamp shifting apparatus comprises:

(A) a first keyed sleeve keyed to said pipe clamp rod to rotate therewith;

(B) a keyed pin adapted to selectively engage said first keyed sleeve to rotate with said sleeve and said pipe clamp rod;

(C) a second keyed sleeve keyed to said keyed pin to rotate therewith; and (D) an actuating mechanism mounted with said second keyed sleeve to cause said sleeve to rotate, whereby actuation of said actuating mechanism causes said second keyed sleeve to rotate said keyed pin, causing said first keyed sleeve and said pipe clamp rod to rotate to shift said pipe clamp between the first and second positions;

(5) a clamp rod locking mechanism for selectively locking said pipe clamp rods to thereby lock respective said pipe clamps in the first or second positions;

(b) a pair of spaced support arms for pivotally mounting said carousel to said mast;

(c) carousel rotating means for selectively rotating said carousel about the first axis; and (d) carousel indexing and locking means for selectively indexing and locking said carousel relative to said support arms.

12. The apparatus of claim 11, wherein said clamp rod locking mechanism comprises:

(a) first locking key means mounted with said carousel central frame;

(b) second locking key means formed with said clamp shifting apparatus first keyed sleeve, and adapted to selectively engage said first locking key means to inhibit rotation of said clamp rod relative to said carousel frame; and (c) resilient means for constantly urging said second locking key means into locking engagement with said first locking key means, whereby said keyed pin is adapted to selectively engage said first keyed sleeve to urge said sleeve against the action of said resilient means into an unlocked position wherein said first and second locking key means are disengaged, permitting said first keyed sleeve and said pipe clamp rod to rotate to shift said pipe clamp between the first and second positions.

* * * * *